US008998710B2

(12) United States Patent
Atkinson

(10) Patent No.: US 8,998,710 B2
(45) Date of Patent: Apr. 7, 2015

(54) MARKETING SYSTEM AND METHODS FOR USE WITH ELECTRONIC GAMING MACHINES

(76) Inventor: Keith Atkinson, Henderson, NV (US)

( * ) Notice: Subject to any disclaimer, the term of this patent is extended or adjusted under 35 U.S.C. 154(b) by 1170 days.

(21) Appl. No.: 12/474,627

(22) Filed: May 29, 2009

(65) Prior Publication Data

US 2010/0075753 A1 Mar. 25, 2010

Related U.S. Application Data

(60) Provisional application No. 61/099,857, filed on Sep. 24, 2008.

(51) Int. Cl.
*G07F 17/32* (2006.01)

(52) U.S. Cl.
CPC ..... *G07F 17/32* (2013.01); *G07F 17/3227* (2013.01)

(58) Field of Classification Search
USPC ..... 463/25, 26, 29
See application file for complete search history.

(56) References Cited

U.S. PATENT DOCUMENTS

| | | | | |
|---|---|---|---|---|
| 5,941,772 | A | 8/1999 | Paige | |
| 5,971,271 | A | 10/1999 | Wynn et al. | |
| 6,089,975 | A | 7/2000 | Dunn | |
| 6,113,495 | A | 9/2000 | Walker et al. | |
| 6,253,119 | B1 | 6/2001 | Dabrowski | |
| 6,263,258 | B1 | 7/2001 | Dabrowski | |
| 6,315,666 | B1 | 11/2001 | Mastera et al. | |
| 6,379,246 | B1 | 4/2002 | Dabrowski | |
| 6,540,609 | B1 | 4/2003 | Paige | |
| 6,598,788 | B1 | 7/2003 | Dabrowski | |
| 6,712,698 | B2 | 3/2004 | Paulsen et al. | |
| 6,860,810 | B2 | 3/2005 | Cannon et al. | |
| 6,942,574 | B1 | 9/2005 | LeMay et al. | |
| 7,335,106 | B2 | 2/2008 | Johnson | |
| 7,520,810 | B2 | 4/2009 | Dabrowski | |
| 8,083,592 | B2 | 12/2011 | Wells | |
| 8,088,014 | B2 | 1/2012 | Wells | |
| 8,282,480 | B2 | 10/2012 | Wells et al. | |
| 8,371,937 | B2 | 2/2013 | Wells | |
| 8,388,424 | B2 | 3/2013 | Dabrowski | |
| 2007/0243928 | A1* | 10/2007 | Iddings | 463/26 |
| 2010/0100776 | A1* | 4/2010 | Murakami | 714/57 |
| 2013/0072310 | A1 | 3/2013 | Wells | |

* cited by examiner

*Primary Examiner* — Thomas L Dickey
(74) *Attorney, Agent, or Firm* — Newman Law, LLC

(57) ABSTRACT

Systems and methods connected to, or in communication with, various components operatively associated with an electronic gaming machine for displaying programming or marketing content on a electronic gaming machine display without affecting the manner or mode of game play provided by the electronic gaming machine, which in some embodiments are configured for detecting conditions associated with gaming machine inactivity, displaying programming or marketing content on the electronic gaming machine display during periods of gaming machine inactivity instead of any prior programmed gaming machine inactivity content, and displaying the normal gaming machine content or prior programmed gaming machine inactivity content upon detecting conditions associated with gaming machine activity thereafter.

16 Claims, 6 Drawing Sheets

Detect a data signal from EGM
12
10
Begin recording passage of time
14
Compare time with threshold time period
16
No
Yes
Second data signal detected?
No
Has threshold been met?
18
20
Yes
Continue transmitting presentation data
26
No
Trigger transmission of presentation data
Second data signal detected?
24
22
Yes
Terminate transmission of presentation data
28

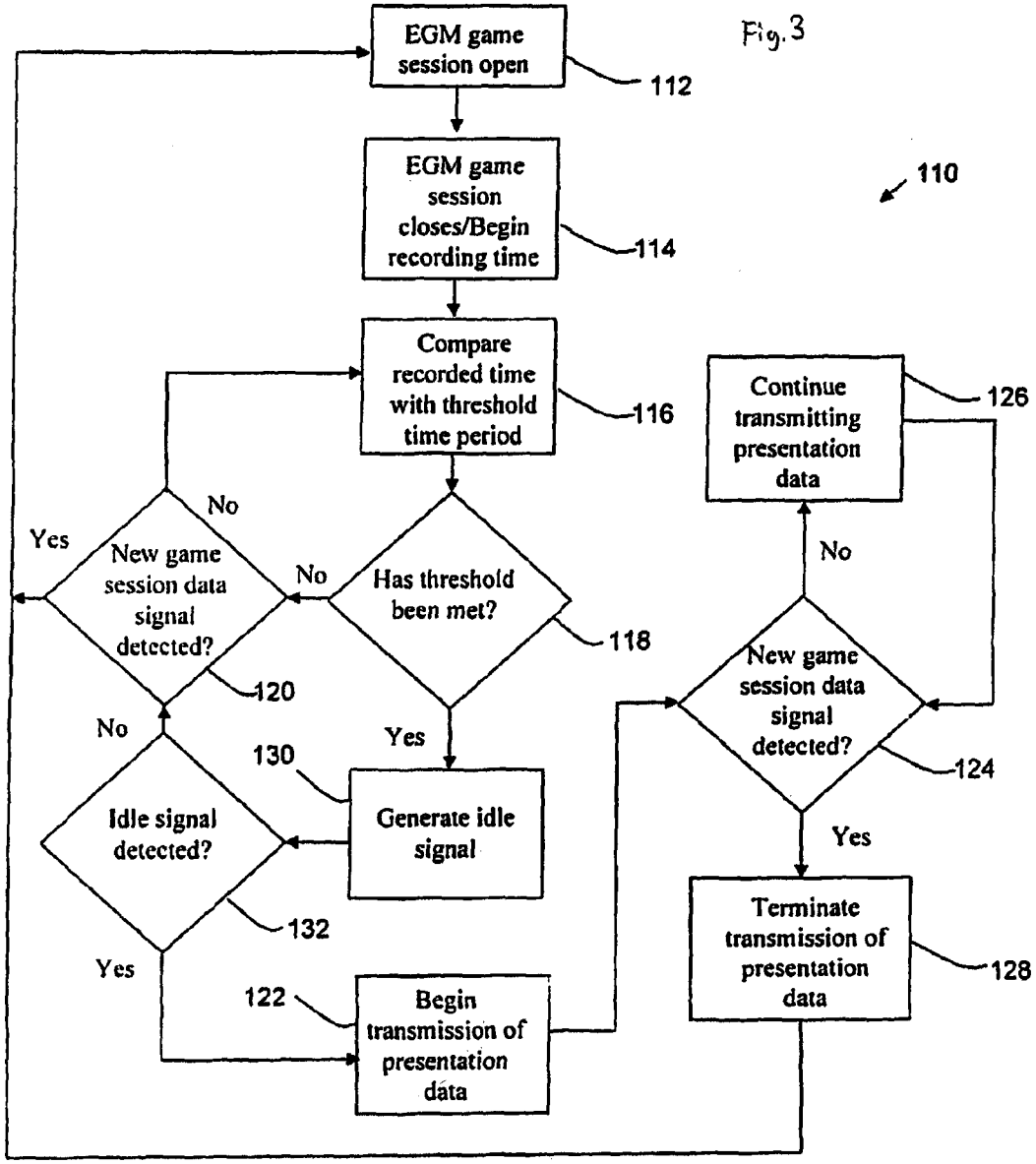
Fig. 3
EGM game session open
112
EGM game session closes/Begin recording time
114
110
Compare recorded time with threshold time period
116
Continue transmitting presentation data
126
Yes
No
New game session data signal detected?
120
No
Has threshold been met?
118
No
New game session data signal detected?
124
Yes
No
130
Generate idle signal
Idle signal detected?
132
Yes
Yes
Terminate transmission of presentation data
128
122
Begin transmission of presentation data

MARKETING SYSTEM AND METHODS FOR USE WITH ELECTRONIC GAMING MACHINES

CROSS-REFERENCE TO RELATED APPLICATIONS FROM WHICH PRIORITY IS CLAIMED

This application claims the benefit of U.S. Provisional Application No. 61/099,857 filed Sep. 24, 2008.

FIELD OF THE INVENTION

The embodiments of the present invention are directed to systems and methods for turning electronic wagering games into marketing devices while the electronic game is inactive.

BACKGROUND OF THE INVENTION

Electronic gaming machines (EGM), such as a slot machines, video poker, blackjack or keno machines, typically include an outer cabinet that houses a main controller, several peripheral devices, and wiring harnesses to electrically connect the peripheral devices to the main controller. The main controller may, for example, include one or more printed circuit boards carrying one or more processors, a plurality of logic devices, and one or more memory devices for storing executable program code and game data. The memory devices for storing executable code may, for example, include EPROMS, hard disk drives, SD-Cards, Compact FLASH cards, CD-ROMs, DVDs, and Smart Media cards. The stored executable code provides two basic functions, namely, providing an operating system for controlling the gaming machine and handling communications between the gaming machine and an external network, and the game code for conducting a game on the gaming machine. While not in use, the EGM is typically programmed to display a menu of the games offered on its main display screen.

SUMMARY OF THE INVENTION

The embodiments of the present invention are directed to systems and methods for providing an alternative presentation to the EGM display while the EGM is inactive.

In one embodiment, there is a support structure for a marketing device of the embodiments of the present invention. The support structure may be embodied by a housing or other suitable body for securing components of the embodiments of the present invention. The support structure may be installed anywhere on the interior or exterior of the EGM.

The marketing device of the embodiments of the present invention includes a connection with the EGM through the SMIB (Slot Machine Interface Board), or other EGM device which handles external communications between the EGM and an external network, for the purpose of detecting data signals (or the lack thereof) or another indicator of EGM inactivity.

In one embodiment, the marketing device is connected to the EGM via a SMIB or other printed circuit board in communication with the EGM by a serial cable or other data communication link to a port, such as an RS-232, RS422, RS485 ports, and is capable of detecting SAS communication in the form of protocol data signals which are generated by the EGM as a result of normal user-initiated EGM activity, such as using the bill validator, game start, access door open, depressing buttons, coin in, screen touch or other indication of entry by the EGM into a pre-game start mode. In some embodiments, the marketing device is connected so that it can detect SAS communication but is configured so that it does not impact such communications, that is, it only receives data passively without transmitting data or otherwise affecting the transmissions detected. In some embodiments, the marketing device connection with an EGM is independent of the EGM operating system, although the marketing device is able to detect communication or signals generated by the EGM operating system.

The marketing device of the embodiments of the present invention may further include a data communication intercept component which is configured to allow for the preemption of the transmission of display data from the main game control board, or other device for controlling the one or more games displayed on the EGM display, upon being triggered by the delivery of presentation data to the intercept component. So long as presentation data or content, or marketing data or content, is not delivered, the intercept component is configured to allow the display data to bypass the intercept component without disruption.

In one embodiment, the intercept component is configured to receive the VGA compatible cable or other data communication link which supplies the video data from the EGM main game control board and deliver the video data via a data communication link with the EGM main video monitor. The delivery of presentation data to the intercept component triggers a data stream switch so that the presentation data preempts the transmission of video data. Thus, the presentation data will be displayed on the EGM main video monitor rather than the typical inactive mode video data.

A memory device for storing or supplying the presentation data is operatively associated with the marketing device. The memory may be affixed to the support structure or may be an independent, remote memory device configured for supplying the presentation data to the marketing device through a wired or wireless connection. The memory device may be of any conventional kind for storing accessible data. The presentation data may consist of audio, graphics, video, or multimedia data. It is envisioned that the presentation data may be intended for advertising or promotional purposes, however, the presentation data may be intended for other purposes and directed to any subject.

The marketing device of the embodiments of the present invention may include control programming and a processor for recording or otherwise keeping track of the passage of time after detecting a first data signal through the connection with the EGM SMIB, and time sync with the video server and monitoring the passage of time thereafter, comparing the passage of time with a preset timing threshold value, triggering the transmission of presentation data to the data communication intercept upon the passage of time reaching the preset threshold value, and terminating the transmission upon detecting a second data signal.

Although the preset timing threshold value may be set to any value by the operator (e.g., seconds, minutes or hours), it is envisioned that a value is selected that best estimates the time at which the EGM is inactive, that is, a game is not being played by a user. In some embodiments, once the transmission of presentation data begins, it will continue until a data signal is detected through the connection with the SMIB, thus indicating that the EGM has been made active by user actuation.

In some embodiments, the EGM may include peripheral devices, such as a touchscreen, which do not generate SAS communication. In such embodiments, the marketing device may have additional connections for determining if such devices are activated. For example, if the EGM has a touchscreen, the marketing device can be configured to detect if the touchscreen is touched and terminate the transmission of presentation data and return to the normal EGM display in response. Thereafter, the marketing device may keep track of the passage of time and if no further activity is detected, the marketing device may again preempt the normal EGM display for the transmission of presentation data.

In this manner the marketing device does not change, alter or affect the manner or mode of play of the EGM. Rather, the marketing device only affects what the video monitor of the EGM will be displaying while the EGM is inactive and not being played by a user. The marketing device also does not change, alter or affect the game controller, the game erasable programmable read-only memory (EPROM), the game graphics or the theoretical hold of the EGM. The marketing device of the embodiments of the present invention is configured to remain inactive during all forms of interaction and play on the EGM by a user. The marketing device merely detects signals that are normally generated internally by the EGM, via the connection with the SMIB or any other suitable point at which such signals may be detected.

Some embodiments are directed to a system configured for an electronic gaming device having at least a controller, memory, game player interface and display. The system includes a gaming device status detector configured to passively detect the status of the electronic gaming device and differentiate between detected status conditions associated with gaming machine activity and detected status conditions associated with gaming machine inactivity. This embodiment also includes a marketing content supplying device configured to transmit marketing content to the display responsive to the detection of status conditions associated with gaming machine inactivity. The marketing content supplying device may further be configured to transmit the marketing content after the passage of a preset period of time from the detection of status conditions associated with gaming machine inactivity as well as cease the transmission of said marketing content to the display responsive to detection of status conditions associated with gaming machine activity by said detecting means.

In some embodiments, the aforementioned system may include a preemption device configured to prevent pre-existing internal gaming machine inactivity content from being displayed on the display in favor of displaying the transmitted marketing content on the display until the transmission of the marketing content ceases. In some embodiments, the detected conditions associated with gaming machine activity and gaming machine inactivity are preset to facilitate the differentiation thereof by the gaming device status detecting means.

In some embodiments, the gaming device status detector is in communication or otherwise connected with one or more components of the electronic gaming device for detecting various parameters relating to the components that can be used to determine the status condition, namely whether the gaming machine is active or inactive. In some embodiments, the detector in a system such as the aforementioned system is further configured to differentiate status conditions associated with game play by detecting data signals relating to one or more of the following: bill validator usage, game player interface usage, coin in detection, game card usage and touch screen usage.

In some embodiments, the aforementioned system further includes memory which can communicate with the marketing content supplying device and is configured for storing the marketing content.

In some embodiments, the aforementioned system further includes a device or configuration for receiving marketing content from a remote source.

In some embodiments, the aforementioned system further includes a data stream switch having multiple data stream inputs. In such embodiments, the data stream switch is configured for outputting the marketing content upon detection of the transmission of marketing content from the marketing content supplying means regardless of other data stream input to the switch.

Some other embodiments are directed to a system configured for an electronic gaming device having at least a controller, memory, game player interface and display which includes a data processor and a data stream switch, which may have multiple data stream input sources and an output in communication with the electronic gaming device display. The data processor is operatively associated with the electronic gaming device for passively detecting conditions within the electronic gaming device, differentiating between conditions associated with gaming device activity and conditions associated with gaming device inactivity, actuating a transmission of marketing content in response to the passage of a preset period of time after detecting conditions associated with gaming device inactivity, and ending the transmission of marketing content in response to the detection of conditions associated with gaming device activity, among other things. The data stream switch is configured to receive the transmission of marketing content actuated by the data processor as an input, wherein the data stream switch is further configured to output the marketing content for display on the electronic gaming device display by automatically preempting any pre-existing gaming device inactivity content input from being outputted for display on electronic gaming device while receiving the transmission of marketing content, among other things. It should be understood that the data processor of some embodiments may further embody or access control programming, firmware or software to facilitate the functions or configurations described herein.

The conditions detected, that is, conditions associated with either gaming device activity or inactivity, may include data signals generated by a component within the gaming device. The conditions detected may also include voltage or current changes within the electronic gaming device or relating to a component thereof.

In some embodiments, the aforementioned system further includes a data storage device in communication with the data processor and data stream switch for storing marketing content. In some embodiments, the data processor and data stream switch are mounted within the electronic gaming device, while in other embodiments one or both of these components are independent of the electronic gaming device.

In some embodiments, a data stream switch in a system such as the aforementioned system is configured for receiving marketing content from a remote source. The remote source may communicate via a wired or wireless connection with the data stream switch.

In some embodiments, a data processor in a system such as the aforementioned system is further configured to maintain records relating to the duration of time the marketing content is transmitted.

In some embodiments, wherein the data processor is further configured for determining the display characteristics of the pre-existing gaming device inactivity content or game idle content, and adjusting the display characteristics of the marketing content to substantially match the display characteristics of the pre-existing gaming device inactivity content for display on the electronic gaming device display.

Some embodiments are directed to a method of presenting marketing content via an electronic gaming machine including at least a controller, memory, game player interface and display. The method includes the steps of: detecting data signals generated by the electronic gaming device during play sessions and idle time; tracking time after detecting a data signals associated with idle time; triggering a transmission of marketing content to the display responsive to the tracked time after detection of the data signal exceeding a threshold period of time; and ceasing the transmission of said marketing content to the display responsive to detection of a subsequent data signal associated with play sessions.

In some embodiments, the aforementioned method further includes transmitting marketing content to the display from a remote source or local source, or a combination thereof.

In some embodiments, the aforementioned method further includes the step of preempting pre-existing internal game idle content from being displayed in favor of displaying said marketing content.

Some embodiments are directed to an EGM configured for providing an interactive game which includes a display, memory containing display content including game play content, a player interface for inputting information and player selections relating to the interactive game, and a game controller configured for facilitating game play of the interactive game, including receiving information from the player interface and providing game content on the display during game play. The aforementioned EGM further includes a data processor and a data stream switch. The data processor is configured for passively detecting data communication within the gaming machine, differentiating between the data communication associated with game play and the data communication associated with a game idle state, actuating a transmission of marketing content in response to the detection of data communication associated with a game idle state and ending the transmission of marketing content in response to the detection of data communication associated with game play, among other things. The data stream switch may include multiple data stream input sources and an output in communication with the display, among other things. The data stream switch may further be configured to receive the transmission of marketing content actuated by the data processor as a data stream input, preempt any other display content input from being outputted by the data stream switch for display and output the marketing content being received by the data stream switch for display while the transmission is received.

In some embodiments, the display content in an EGM such as the aforementioned EGM further includes game idle content, and the game controller is further configured to present the game idle content on the display during the game idle state. In some of these embodiments, the data stream switch may be further configured to automatically preempt the display of game idle content upon receiving the transmission of marketing content, and the data processor may be further configured to actuate the transmission of marketing content after a preset period of time from the detection of data communication associated with a game idle state.

The data processor and data stream switch may be integral with the EGM or mounted independently. In some embodiments, the aforementioned EGM also includes a data storage device containing the marketing content.

BRIEF DESCRIPTION OF THE DRAWINGS

FIG. 3 illustrates an alternative exemplary process for the operation of a device according to some embodiments of the invention;

DETAILED DESCRIPTION OF INVENTION

Figure 1:
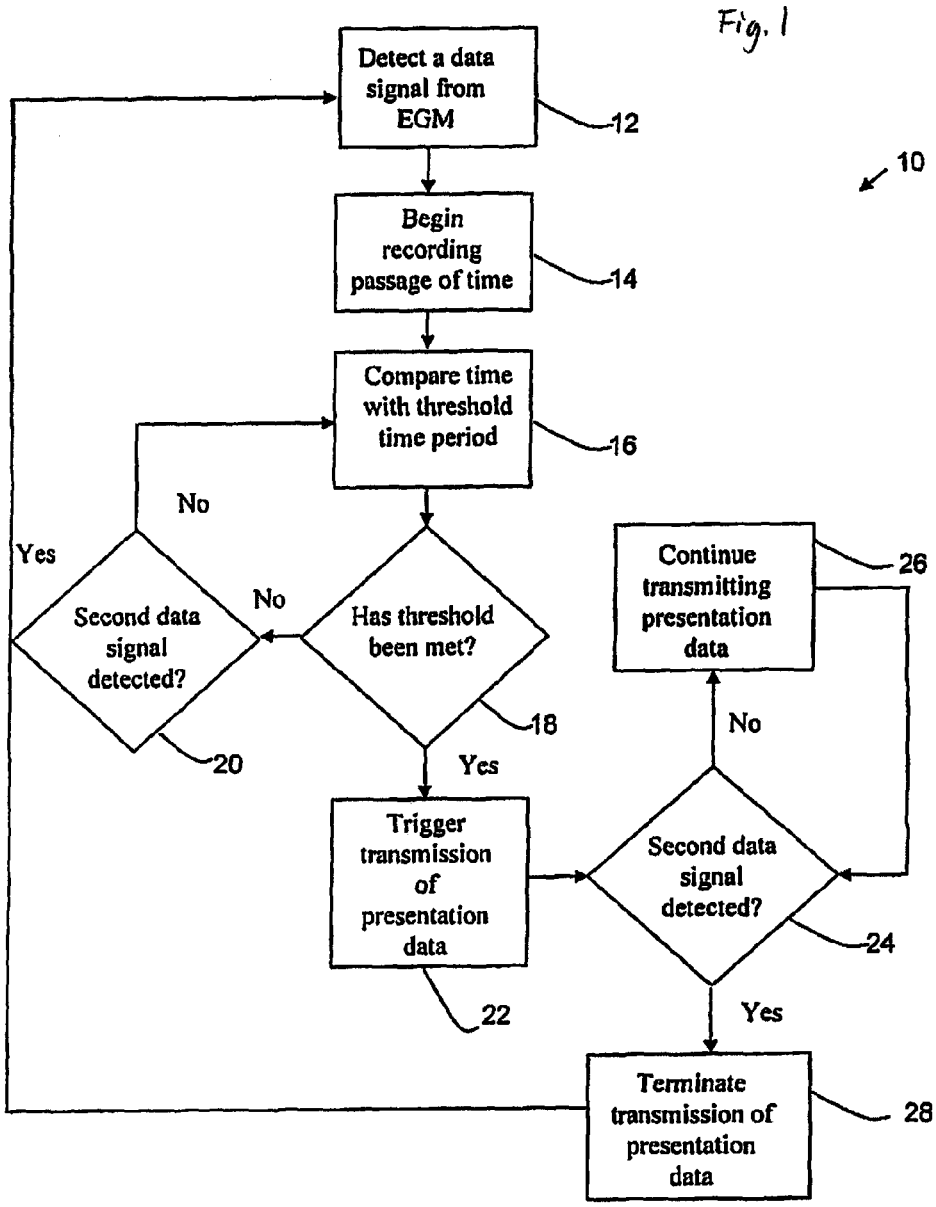
FIG. 1 illustrates an exemplary process for the operation of a device according to some embodiments of the invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the embodiments of the present invention is thereby intended. Any alterations and further modifications of the inventive feature illustrated herein, and any additional applications of the principles of the embodiments of the present invention as illustrated herein, which would normally occur to one skilled in the relevant art and having possession of this disclosure, are to be considered within the scope of the present invention as claimed.

FIG. 1 illustrates an exemplary process for the operation of a device according to the embodiments of the present invention which is generally referred to by the reference number 10. In step 12, a data signal from the EGM is detected by the marketing device. The detection begins a timer in step 14 which monitors the passage of time from the moment the data signal was first detected. The monitored time is compared with a preset threshold time period value in step 16. If in step 18, the threshold has not been met, and a second data signal is not detected in step 20, the method returns to step 16 and continues to compare the passage of time with the threshold value. If a second data signal is detected in step 20, it is assumed that the EGM is active and in use by a user and the method starts over in step 12.

Upon the monitored time period reaching the threshold value in step 18, the transmission of presentation data is triggered in step 22. As discussed above, the presentation data preempts the video data being provided to the EGM by the EGM control board and the presentation data is shown on the EGM display. If a second data signal is not detected, the transmission of presentation data continues, as shown in steps 24 and 26. However, if a second data signal is detected, the transmission of presentation is terminated, ceasing the preemption of video data so that the EGM display once again shows the video data as it had prior to the preemption by the presentation data, and the method restarts its detection of data signals at step 12.

Figure 2:
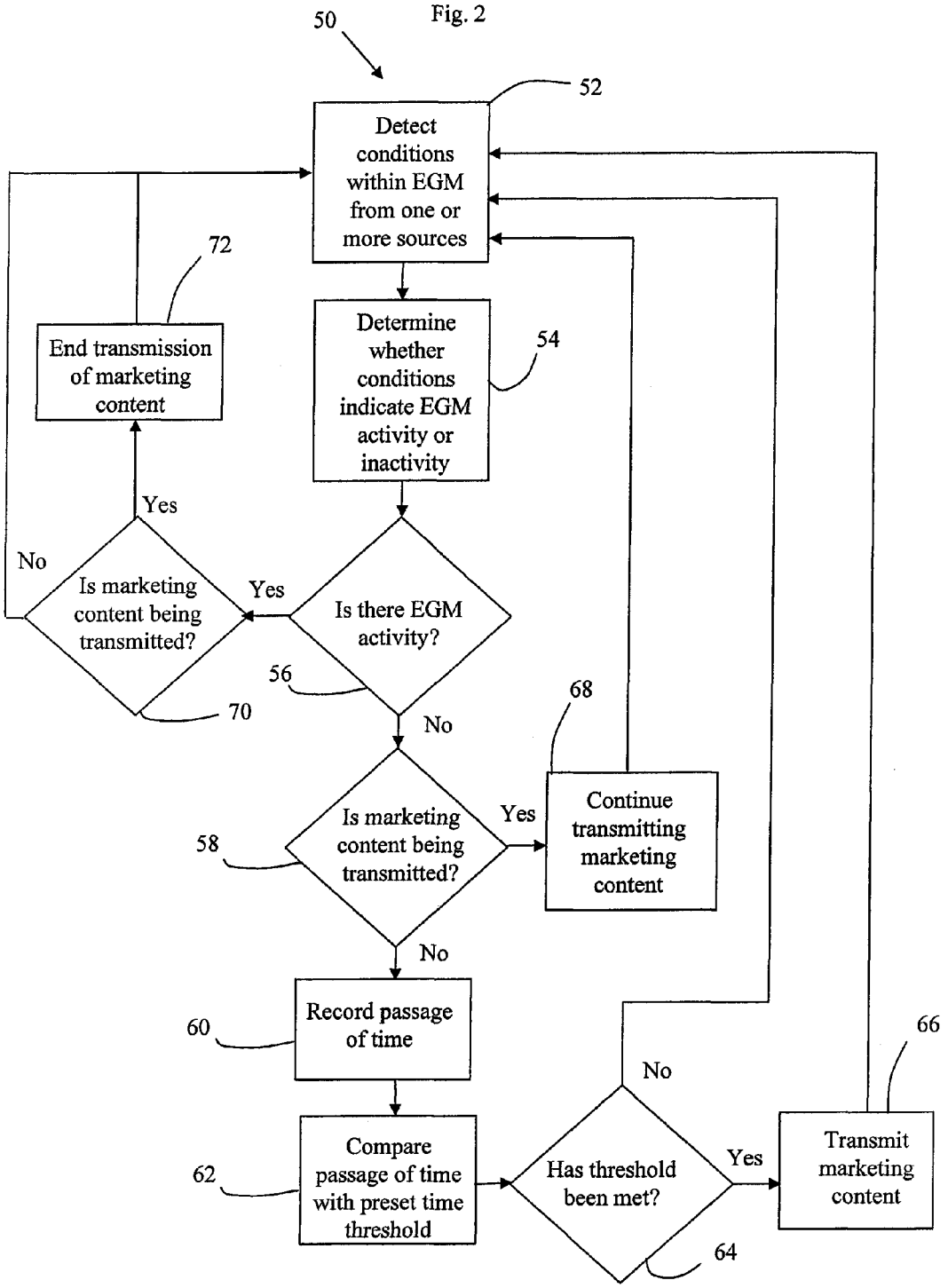
FIG. 2 illustrates an exemplary process for the operation of a system according to some embodiments of the invention.

FIG. 2 illustrates another exemplary process for the operation of a system according to the embodiments of the invention which is generally referred to by the reference number 50. In this embodiment, system 50 is in communication with one or more sources, such as components within the EGM which would exhibit changes or conditions that are associated with either gaming machine activity or gaming machine inactivity (i.e., the gaming machine is in an active state, as in being played, or inactive state), for the purpose of passively monitoring those conditions. In step 52, system 50 detects conditions within the EGM. In step 54, system 50 determines whether the detected conditions indicate EGM activity or inactivity.

In some embodiments, system 50 may determine whether the detected conditions indicate EGM activity or inactivity based on a comparison with preset parameters that are associated with either EGM activity or inactivity, such as for example, a voltage change or the characteristics of a data signal generated by one or more sources. Thus, if a condition associated with a preset parameter is detected, then system 50 would recognize whether the condition is associated with EGM activity or inactivity.

If it is determined that the EGM is not active, and marketing content is not already being transmitted, as shown by steps 56 and 58, then system 50 will begin to record the passage of time in step 60. As shown by step 62, the passage of time will be compared with a preset time threshold. If the threshold has been met in step 64, then in step 66 system 50 will transmit marketing content to the display.

In some embodiments the marketing content is transmitted to the display via a video switch which is configured to favor the marketing content transmission over any pre-existing EGM inactivity display content.

If the time threshold has not been met, then as shown by step 64, system 50 continues to detect conditions, determine whether the detected conditions are associated with either EGM activity or inactivity, and record the passage of time in steps 52, 54, 56 and 60, respectively, if it is determined that the EGM is inactive. Thus, the transmission of marketing content in step 66 will not occur until the time threshold is met while the EGM is inactive. Likewise, the transmission of marketing content, once begun, will continue as shown particularly by steps 58 and 68 so long as the EGM remains inactive.

If it is determined that the EGM is active in step 56, then as shown in steps 70 and 72 the transmission of marketing content will discontinue and system 50 returns to detecting conditions in step 52. Also, as shown in steps 56 and 70, if it is determined that the EGM is active prior to meeting the time threshold in step 64 or before the transmission of marketing content in step 66, then system 50 returns to detecting conditions in step 52.

In other embodiments, the time period may be preset in the system according to the last activity associated with the EGM prior to the EGM becoming inactive. For example, if the EGM has just finished being serviced, the time threshold in step 64 may be increased or decreased. Alternatively, the system may require the meeting of a second time threshold in addition to the time threshold in step 64, based on the last activity associated with the EGM prior to the EGM becoming inactive.

In alternative embodiments, the transmission of marketing content may be paused at intervals, such as between the end of one advertisement, presentation or program included in the marketing content and prior to the start of another advertisement, presentation or program included in the marketing content. During the pause in the transmission of marketing content, the EGM may display the existing EGM inactivity content, which may consist of simulated game play, for example. In such embodiments, the transmission of marketing content may continue upon the passage of a second time period, that is, the meeting of a second time threshold. The second time period may be the same or different from the initial time threshold which had been met in step 64 prior to the start of the transmission of marketing content. Alternatively, the transmission of marketing content may not be paused, but rather, simulate a pause and display information regarding the game, EGM, marketing content and/or indicate on the display that the game is available for play by presenting the appropriate text, such as "press any button or insert money to play game." In some embodiments, similar text, graphics or other information may be presented on the display during the transmission of marketing content.

FIG. 3 illustrates an alternative exemplary process for the operation of a device according to the embodiments of the present invention, generally referred to by the reference number 110. In this embodiment, the device is configured to detect a signal that the EGM is entering an idle mode. An EGM idle signal may be generated after the passage of a preset period of time from when a game session on the EGM closes. Typically, a game session closes when a player session runs without play for one minute which results in End Game. For example, the preset time period may be one minute. If a player card is left or abandoned in the machine after a game session closes, the EGM idle signal may be generated after the passage of a longer period of time from when the game session closes, such as two minutes. The period of time for the EGM to generate an idle signal may vary, and may depend on the specific event causing the game session to close.

It should be understood that the idle signal may comprise any signal or plurality of signals which indicate the EGM is inactive, that is, no longer being played by a player. In some embodiments, the idle signal may comprise "keep alive" signals or other standard periodic connection check generated by the EGM. Thus, so long as the idle signals are detected, the transmission continues. However, should there be a signal detected that indicates either the EGM is active or a peripheral that does not generate a signal has been actuated, such as a touchscreen, the transmission ceases and the normal EGM display returns.

In this embodiment, an open game session in step 112 closes and the system begins recording time in step 114. As mentioned above, the threshold time period may vary depending on the event that closes the game session. Thus, the passage of time is compared with the appropriate preset threshold in step 116. In step 118, if the threshold has not been met and a data signal indicating a new game session is open is not detected in step 120, the method returns to step 116 and continues to compare the passage of time with the threshold value. If a new game session signal is detected in step 120, the EGM is active and in use by a user and the method starts over in step 112 until this new game session closes.

Once the monitored time period reaches the threshold value in step 118, the EGM goes into idle mode and an idle signal is generated by the EGM in step 130 which may also be detected in step 132. If the idle signal is not detected in step 132, the method returns to step 120 to determine whether a new game session has opened. If the idle signal is detected in step 132 then the transmission of presentation data begins in step 122. As discussed above, the presentation data preempts the video data being provided to the EGM by the EGM control board and the presentation data is shown on the EGM display. If a game session is not opened, the presentation data continues to be supplied to the EGM display, as shown in steps 124 and 126. However, if a new game session signal is detected, the transmission of presentation is terminated, ceasing the preemption of video data so that the EGM display once again shows the video data as it had prior to the preemption by the presentation data, thus allowing the game session to be played by the player, as shown in step 112.

In one embodiment, a system of the embodiments of the present invention may include the components such as an interface board capable of instantly switching between an EGM video source and a secondary source of presentation or video data. The interface board may be configured with memory, processing devices, operating systems, communication devices and other hardware or software as necessary. The secondary video source may be an outside server or videos stored within the memory on the interface board.

The board may include a connection with the EGM for monitoring for the presence of game idle and game active signals, such as SAS protocol signals generated during EGM events. While the game is active, the EGM game video is played on the display. Upon detection of a game idle signal, the interface board switches video sources from the EGM video source to the secondary video source. The interface board is configured to decode or play videos from the secondary video source on the EGM display. Upon detection of a game active signal, the interface board switches video sources to the EGM video source and the playing of the video from the secondary video source is stopped. The memory may record the particular video played, how long it played or if it finished, the time and date for each video played, amount of times each video played, or other pertinent statistics or data relating to the provision of videos to the EGM display according to the embodiments of the present invention.

The switching of video sources may be accomplished by a physical hardware connection with the EGM game video source and/or secondary video source or through software.

In one embodiment, video data is provided to the memory on the interface board through a periodic download from a video server. The downloading of data may be facilitated by wireless or wired connection. It is envisioned that the interface board will maintain a completely separate connection for transceiving data than the EGM. Thus, if a wired connection is used, it may be completely independent of the EGM connection with the central computer system used by the casino or gaming establishment, and may conform to applicable cabling standards.

In this embodiment, the video server may be connected with a plurality of interface boards, each being operatively associated with one or more EGMs. The video server may manage and control the provision of videos to the video displays through each interface board. It may also provide video data to each memory, remove video data, provide updates, or retrieve statistics relating to the provision of videos via the interface board. This information may be collected from each interface board, saved in a video server database and presented to casinos and ad agencies for accounting and billing purposes via a user-accessible webpage or other reporting method.

Figure 4:
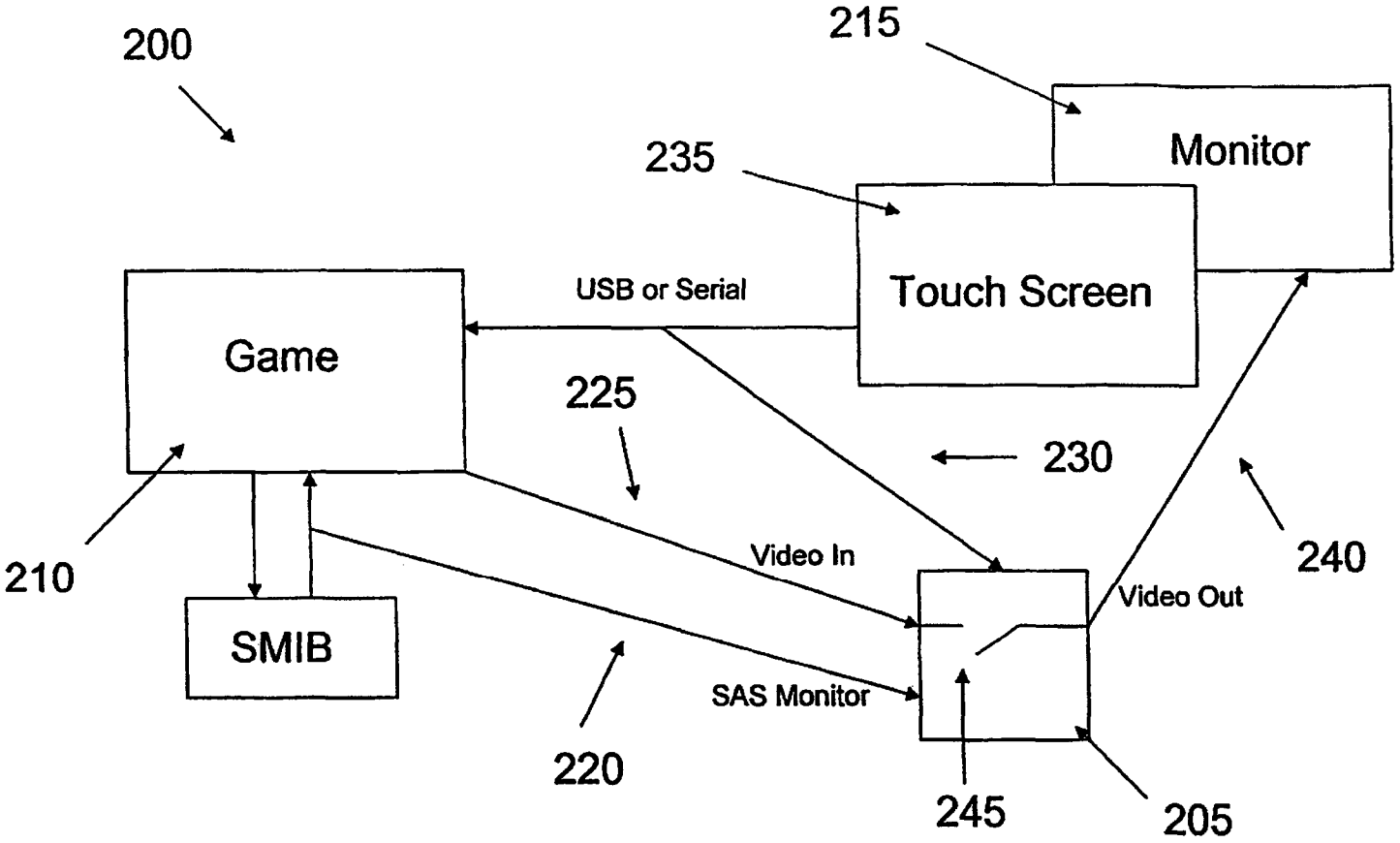
FIG. 4 illustrates an exemplary block diagram of one system architecture according to some embodiments of the invention.

FIG. 4 illustrates an exemplary block diagram of one system architecture according to the embodiments of the present invention generally referred to by reference numeral 200. System 200 includes, among other things, a single board computer 205 with three inputs from the electronic gaming machine 210 and one output to the monitor 215. The three inputs include the SAS monitor cable 220, video in cable 225 and USB or serial monitor cable 230. The SAS monitor cable 220 allows the single board computer 205 to monitor SAS traffic (i.e., data packets) from the electronic game machine 210 to the host thereby allowing the computer 205 to determine when the electronic gaming machine 210 is in use despite the touch screen 235 not being used (e.g., physical buttons being used).

In some embodiments, a board computer such as board computer 205 is in communication with one or more components of electronic gaming machine 210, such as the touch screen, ticket printer, SMIB, one or more button lamps, one or more indicator lamps or "candles" or other components associated with electronic gaming machine 210, for receiving information or passively detecting changes associated with either game idle or game active states, such as current changes, voltage changes, data transmissions relating to such components or other change of conditions.

For example, in some embodiments, computer 205 is configured to determine by monitoring the lamp voltages in the top candle, bottom candle and cash out button, that the electronic gaming machine 210 is in a condition associated with being in use, such as for example, having player credits thereon, being in tilt mode, waiting on a hand pay or jackpot delivery, has an open door, or the service light has been pressed. In some embodiments, if any such conditions are detected, marketing content will not be displayed until a preset delay time period has passed from when the condition is cleared, that is, the point at which the condition is no longer detected by the system.

System 200 may include preset detection parameters, that is, it may be configured to associate certain conditions with the gaming machine being in use. It should be readily apparent that these preset detection parameters may be changed to include other detectable conditions to be associated with game activity, or certain detectable conditions may be excluded as not being associated with game activity, as necessary depending on the configuration of the particular gaming machine or to achieve the desired results.

In one embodiment, the USB host controller (i.e., the game) polls the touch screen 235 every millisecond to determine if any touch screen activity exists. In some embodiments, when the touch screen controller reports a touch, the USB host controller polls more frequently. The USB or serial monitor cable 215 allow the single board computer 205 to determine when the touch screen 235 of the electronic gaming machine 210 is in use. The USB or serial monitor cable 215 inputs into a general-purpose input pin on the single board computer 205. The video in cable 225 diverts normal game video through the single board computer while video out cable 240 diverts the normal game video to the monitor 215. The video in cable 225 comprises a VGA (analog or digital) cable from the electronic gaming machine 210 to a VGA-IN port of the computer 205. The video out cable 240 comprises a VGA cable plugged into a VGA-OUT port of the computer 205 and leading to the monitor 215. Responsive to the inputs generated by the SAS monitor cable 220 and USB or serial monitor cable 230, a video switch 245 opens and closes as set forth above to direct the proper video to the monitor 215.

Figure 5:
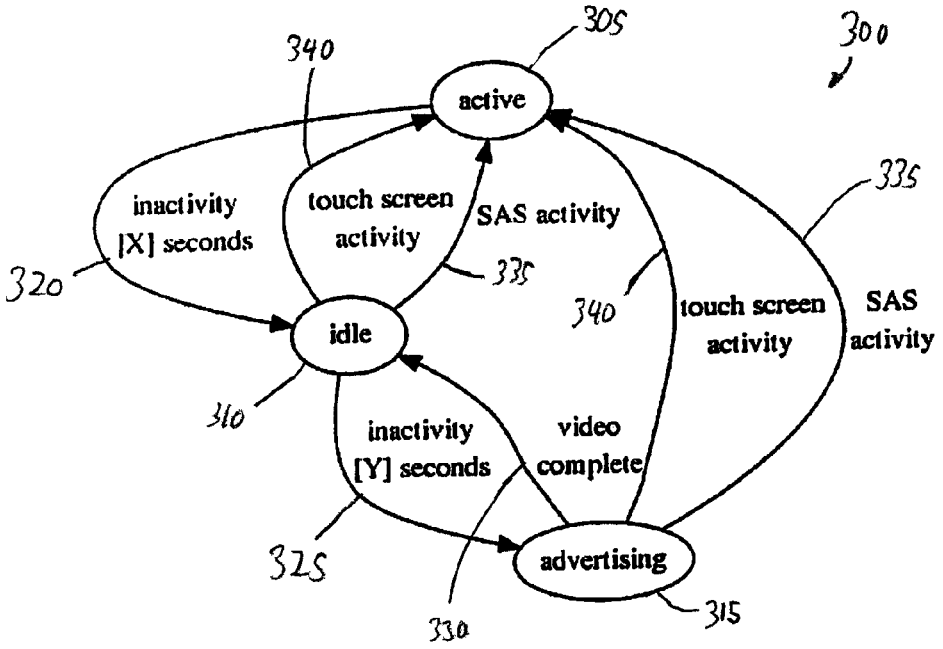
FIG. 5 illustrates a diagram of one system failure model according to some embodiments of the invention.

FIG. 5 provides a diagram of a system failure prevention model 300 according to some embodiments of the present invention. The model 300 details features designed to reduce the probability of failure while the computer 205 has control of the monitor 215 (i.e., sending advertisements to monitor 215). There are three states comprising active 305, idle 310 and advertising 315. The system is in the active state while gaming activities take place on the electronic gaming machine. The system remains in the active state 305 until a pre-established time of inactivity 320 (designated as [X] seconds in model 300). Once the pre-established time of inactivity passes, the system moves into the idle state 310 and toggles between the idle state 310 and advertising state 315, playing a single video or still advertisement until completion 330, then waiting for [Y] seconds of inactivity 325 before deciding to return to the active state 305 or advertising state 315. The video output is only connected to the monitor 215 when the advertisement is playing. Any activity on either the SAS interface 335 or touch screen interface 340 causes a transition to the active state 305 from the idle state 310 or advertising state 315.

In some embodiments, board computer 205 is configured for determining information relating to the characteristics of the normal game video data stream passing through the ports associated therewith, such as display resolution or pixels information, and automatically adjusting the characteristics of the marketing or advertising content to match the characteristics of the normal game video data stream accordingly.

In one embodiment, the system activates the video output only after preparing the advertisement for playback, and deactivates the video before cleaning up after each advertisement to minimize the chances of failure while the game output is not being displayed.

In some embodiments, the system provides a virtual button or other graphical representation as part of the display of marketing content on the EGM display which indicates that the game may be played (and marketing content halted) by touching the touch screen or pressing a button on the EGM. In some embodiments, the display of marketing content may also include a scroll bar or other display of information, such as news, a stock ticker or information regarding gaming tournaments or other local events.

Figure 6:
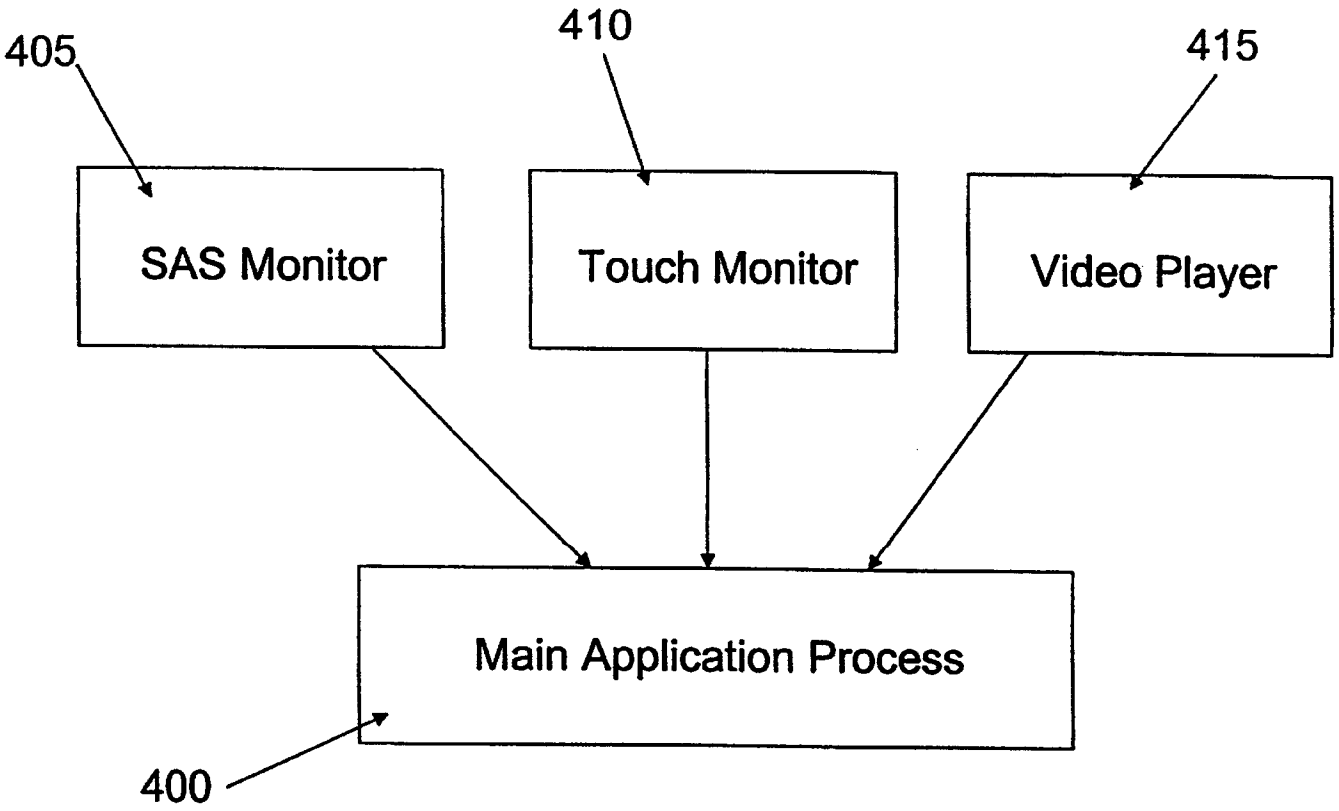
FIG. 6 illustrates a diagram of one process architecture according to some embodiments of the invention.

In one embodiment, in order to limit the exposure to endless loops or other forms of software lock-ups, the system's main application process 400, as facilitated by the computer 205 and shown in FIG. 6, is broken into multiple processes comprising a SAS monitor application 405, touch screen monitor application 410 and video player application 415. When in the active state 305 or idle state 310, the primary application process 400, has two sub-processes comprising the SAS monitor application 405 and touch screen monitor application 410. In one embodiment, the SAS monitor application 405 and touch screen monitor application 410 are each connected to the main application process 400 via a pair UNIX pipes, or other framework for receiving an input stream of information and modifying that input stream for subsequent communication as an output stream, which notify the main application process 400 that there is activity on the electronic gaming machine and the sub-processes are alive. So, the main application process 400 considers the game active if either sub-process notify the main process application 400 that the game is active or if either sub-process does not indicate that it is alive within a customizable time period. If the sub-processes do not notify the main application process 400 that the game is active and the sub-processes are alive, the main application process 400 enters the advertising state 315. Responsive to the video player application 415 beginning, the main application process 400 connects its video output by means of video switch 245 to the monitor 215. When the playback is complete, if SAS or touch screen activity is detected, or if any error is detected, the main application process connects the electronic gaming machine's video to the monitor 215 by means of video switch 245 before transitioning to either the active state 305 or idle state 310.

Those skilled in the art will readily appreciate that methods and systems of the embodiments of the present invention may include various computer and network related software and hardware, such as programs, operating systems, memory storage devices, input/output devices, processors, servers, data communication links, whether wireless or otherwise, and data transceiving devices. Those skilled in the art will further appreciate that the precise types of software and hardware used are not vital to the full implementation of the marketing device according to the embodiments of the present invention so long as a marketing device is provided in accordance with the methods and systems described herein.

It should be understood that the embodiments of the present invention may be implemented to deliver presentation data to one or more EGMs, gaming establishments and throughout multiple jurisdictions. Moreover, the systems and methods according to the embodiments of the present invention are suitable for non-gambling electronic devices (e.g., arcade games).

While exemplary methods and applications of the systems and methods of the marketing device of the embodiments of the present invention have been described herein, it should also be understood that the foregoing is only illustrative of exemplary and/or preferred embodiments, as well as principles of the embodiments of the present invention, and that various modifications can be made by those skilled in the art without departing from the scope and spirit of the embodiments of the present invention. Therefore, the described embodiments should not be considered as limiting of the present invention in any way. Accordingly, the present invention embraces alternatives, modifications and variations which fall within the spirit and scope of the marketing device described herein.

What is claimed is:

1. An electronic gaming machine configured for providing an interactive game, comprising:

a gaming machine display;

gaming machine memory containing display content including game play content;

a gaming machine player interface for inputting information and player selections relating to the interactive game;

a gaming machine controller configured for facilitating game play of the interactive game, including receiving information from the player interface and providing game play content on the gaming machine display during game play;

a memory containing marketing content;

a data processor in communication with the gaming machine controller and configured for passively detecting data communication within the gaming machine, differentiating between the data communication associated with game play and the data communication associated with a game idle state, actuating a transmission of marketing content in response to the detection of the data communication associated with a game idle state and ending the transmission of marketing content in response to the detection of the data communication associated with game play; and a data stream switch having multiple data stream input sources, including the gaming machine memory and the memory containing marketing content as data stream input sources, and an output in communication with the display, wherein the data stream switch is configured for, responsive to receiving the transmission of marketing content actuated by the data processor, preempting any other display content input from being outputted by the data stream switch for display on the gaming machine display and outputting the marketing content being received by the data stream switch for display on the gaming machine display while the transmission of marketing content is received.

2. An electronic gaming machine as recited in claim 1, wherein the display content further includes game idle content and the gaming controller is further configured to transmit the game idle content for display on the gaming machine display during the game idle state.

3. An electronic gaming machine as recited in claim 2, wherein the data stream switch is further configured to automatically preempt the game idle content from being outputted by the data stream switch for display on the gaming machine display upon receiving the transmission of marketing content.

4. An electronic gaming machine as recited in claim 1, wherein the data processor is further configured to actuate the transmission of marketing content after a preset period of time from the detection of data communication associated with a game idle state.

5. An electronic gaming machine as recited in claim 1, further comprising a remote data storage device containing the marketing content in communication with the memory containing marketing content.

6. An electronic gaming machine as recited in claim 1, wherein the data processor records the duration of each transmission of marketing content.

7. An electronic gaming machine configured to provide an interactive game, the electronic gaming machine including a display device, gaming machine memory containing display content, a player interface and a controller, the electronic gaming machine comprising:

a memory containing marketing content;

a data processor in communication with the controller, wherein the data processor is configured to passively detect data communication within the electronic gaming machine, differentiate between data communication associated with game play and data communication associated with a game idle state, actuate a transmission of marketing content responsive to the detection of data communication associated with the game idle state and terminate the transmission of marketing content responsive to the detection of data communication associated with game play; and a data stream switch having the gaming machine memory containing display content and the memory containing marketing content as data stream input sources and an output in communication with the display, wherein the data stream switch is configured to preempt the display content from being output for display on the display device responsive to receiving the transmission of marketing content actuated by the data processor and to output the marketing content for display on the display device until the transmission of marketing content terminates.

8. An electronic gaming machine as recited in claim 7, wherein the display content includes game play content and game idle content and the controller is further configured to transmit the game idle content for display on the display device during the game idle state.

9. An electronic gaming machine as recited in claim 8, wherein the data stream switch is further configured to automatically preempt the game idle content from being outputted by the data stream switch for display on the display device responsive to receiving the transmission of marketing content.

10. An electronic gaming machine as recited in claim 7, wherein the data processor is further configured to actuate the transmission of marketing content after a preset period of time from the detection of data communication associated with a game idle state.

11. An electronic gaming machine as recited in claim 7, further comprising a remote data storage device containing marketing content, wherein the remote data storage is configured to transmit marketing content to the memory containing marketing content.

12. An electronic gaming machine as recited in claim 7, wherein the data processor records the duration of each transmission of marketing content.

13. An electronic gaming machine configured to provide an interactive game, comprising:

a gaming machine display;

gaming machine memory containing display content for display on the gaming machine display, wherein the display content includes game play content and game idle content;

a gaming machine player interface configured to receive player input relating to the provision of the interactive game;

a gaming machine controller configured to facilitate display of the display content on the gaming machine display, including the display of the game play content on the gaming machine display responsive to detecting player input received by the gaming machine player interface and the display of the game idle content on the gaming machine display during a game idle state;

a memory containing marketing content;

a data processor in communication with the gaming machine controller, wherein the data processor is configured to passively detect data communication within the electronic gaming machine, differentiate between data communication associated with player input and data communication associated with the game idle state, actuate transmission of marketing content responsive to the detection of data communication associated with a game idle state and terminate the transmission of marketing content responsive to the detection of data communication associated with player input; and a data stream switch having the gaming machine memory containing display content and the memory containing marketing content as data stream input sources and an output in communication with the gaming machine display, wherein the data stream switch is configured to preempt the display content from being output by the data stream switch for display on the gaming machine display responsive to receiving the transmission of marketing content actuated by the data processor, and to output the marketing content for display on the display device until the transmission of marketing content to the data stream switch terminates.

14. An electronic gaming machine as recited in claim 13, wherein the data processor is further configured to actuate the transmission of marketing content responsive to the passage of a preset period of time from the detection of the data communication associated with a game idle state.

15. An electronic gaming machine as recited in claim 13, further comprising a remote data storage device containing marketing content, wherein the remote data storage is configured to transmit marketing content to the memory containing marketing content.

16. An electronic gaming machine as recited in claim 13, wherein the data processor records the duration of each transmission of marketing content.

* * * * *